US012534922B2

(12) United States Patent
Dai et al.

(10) Patent No.: US 12,534,922 B2
(45) Date of Patent: Jan. 27, 2026

(54) FLOORBOARD CONNECTING BASE AND FLOORBOARD CONNECTING STRUCTURE

(71) Applicant: Zhejiang Kingdom New Material Group Co., Ltd., Jiaxing (CN)

(72) Inventors: Huibin Dai, Jiaxing (CN); Congkun Sheng, Jiaxing (CN); Zhiming Wang, Jiaxing (CN)

(73) Assignee: Zhejiang Kingdom New Material Group Co., Ltd., Jiaxing (CN)

( * ) Notice: Subject to any disclaimer, the term of this patent is extended or adjusted under 35 U.S.C. 154(b) by 203 days.

(21) Appl. No.: 18/487,687

(22) Filed: Oct. 16, 2023

(65) Prior Publication Data

US 2024/0392581 A1 Nov. 28, 2024

Related U.S. Application Data

(63) Continuation of application No. PCT/CN2023/104674, filed on Jun. 30, 2023.

(30) Foreign Application Priority Data

May 26, 2023 (CN) ..... 202310615849.9

(51) Int. Cl.
*E04F 15/02* (2006.01)

(52) U.S. Cl.
CPC .. *E04F 15/02038* (2013.01); *E04F 15/02011* (2013.01); *E04F 15/02016* (2013.01); *E04F 2201/023* (2013.01); *E04F 2201/0517* (2013.01)

(58) Field of Classification Search
CPC ..... E04F 15/02038; E04F 15/02011; E04F 15/02016; E04F 2201/023; E04F 2201/0517
USPC ..... 52/586.1, 586.2
See application file for complete search history.

(56) References Cited

U.S. PATENT DOCUMENTS

| | | | | |
|---|---|---|---|---|
| 3,363,383 A * | 1/1968 | La Barge | E04B 1/68 | 52/287.1 |
| 8,006,458 B1 * | 8/2011 | Olofsson | E04F 15/02 | 52/489.1 |
| 2003/0070382 A1 * | 4/2003 | Tseng | E04F 15/04 | 52/578 |
| 2006/0070332 A1 * | 4/2006 | Palsson | E04F 15/04 | 52/586.1 |
| 2009/0107076 A1 * | 4/2009 | Kim | E04F 15/02 | 52/309.1 |

(Continued)

*Primary Examiner* — Brent W Herring
(74) *Attorney, Agent, or Firm* — Schwegman Lundberg & Woessner, P.A.

(57) ABSTRACT

A floorboard connecting base and a floorboard connecting structure are disclosed in the application. The floorboard connecting base includes a base body, a convex part and a limiting part. The convex part is located at an end of an upper surface of the base body. The limiting part is located at the upper surface of the base body, and is spaced from the convex part to form an installation groove for inserting a floorboard unit, and a free end of the limiting part is bent in a direction towards the convex part to form a step block for limiting the floorboard unit. The floorboard connecting structure according to the disclosure is of a locking type, so it can be paved without glue due to a locking force, which is environment-friendly. A whole structure may extend all around with change of temperature, and there will be no uplift or cracking.

6 Claims, 8 Drawing Sheets

(56) References Cited

U.S. PATENT DOCUMENTS

| | | | | |
|---|---|---|---|---|
| 2009/0151290 | A1* | 6/2009 | Liu | E04F 15/04 52/592.1 |
| 2017/0314591 | A1* | 11/2017 | Baker | E04F 15/02038 |
| 2022/0120092 | A1* | 4/2022 | Wu | E04F 15/02038 |
| 2023/0183987 | A1* | 6/2023 | De Rick | E04F 15/02038 52/582.2 |

* cited by examiner

FLOORBOARD CONNECTING BASE AND FLOORBOARD CONNECTING STRUCTURE

CROSS-REFERENCE TO RELATED APPLICATIONS

This application is a continuation of International Application No. PCT/CN2023/104674 filed 30 Jun. 2023, which claims the benefit of priority to Chinese Application No. 202310615849.9, filed 26 May 2023, the benefit of priority of each of which is claimed herein and which applications are hereby incorporated by reference herein in their entirety.

TECHNICAL FIELD

The disclosure relates to the technical field of home improvement materials, in particular to a floorboard connecting base and a floorboard connecting structure.

BACKGROUND ART

At present, a floorboard, as one of main ways of floor decoration, is widely used in homes, offices, receptions and other places. A wooden floorboard has characteristics of comfortable feet feeling, natural texture and recyclable materials, but shortcomings of the wooden floorboard are poor humidity resistance and anti-aging ability. High humidity is easy to make wood swell, while drying may cause the wood to shrink, which then leads to bulging, warping and others.

There are many ways to connect planes of the floorboard, among which, a lock connection method is widely favored because it can reduce use of glue, can avoid glue and reduce indoor pollution. A connecting piece is one of the most important fittings in floorboard installation. On the one hand, it is required to leave enough expansion and contraction space for thermal expansion and contraction of the floorboard; and on the other hand to protect an edge of the floorboard from abrasion, which functions in connection and protection. However, existing connecting pieces are with poor universality, and different connecting pieces are required to be designed separately for floorboards with different structures. Moreover, some connecting pieces with simple structures have poor stability and weak splicing structure, and there is a problem of deformation after long-term use.

SUMMARY

In view of above problems, a floorboard connecting base and a floorboard connecting structure are provided in the disclosure, which are simple and table in structure and with a firm splicing structure and good universality.

Technical schemes adopted by the disclosure are as follows. A floorboard connecting base is provided in this disclosure, which includes a base body, a convex part and a limiting part. The convex part is located at an end of an upper surface of the base body. The limiting part is located at the upper surface of the base body, and is spaced from the convex part to form an installation groove for inserting a floorboard unit, and a free end of the limiting part is bent in a direction towards the convex part to form a step block for limiting the floorboard unit.

During installation, the floorboard unit is clamped into the installation groove between the limiting part and the convex part. The step block formed by folding the free end of the limiting part towards the convex part can form a semi-enclosed limiting structure for the inserted floorboard unit, so that the floorboard can be stably inserted and clamped, which is with a simple clamping structure, suitable for diversity of floorboard paving and stable in structure.

A locking floorboard connection structure is adopted in this disclosure, and with a locking force, joints can be very tight even if the pavement is glue-free, and problems such as uplift or cracking may not occur due to change of temperature. In addition, the floorboard connecting structure of the disclosure can integrally extend around with the change of temperature as a whole, thus avoiding local uplift, solving a problem of internal deformation and achieving good overall paving effect. For the floorboard connecting structure of the disclosure, a manual paving standard is replaced with an industrial standard, so that error of manual paving is reduced, and the floorboard can enter the groove by pressing or tapping the floorboard when paved, and its installation is simpler.

Optionally, a lower surface of the base body is provided with a first groove, and the first groove is located below the convex part. When the connecting post of the floorboard unit is dropped into the installation groove, the step block and the convex part can open to both sides, and an elastic deformation space of the convex part can be ensured when the first groove is squeezed, which optimizes effect of pressing the floorboard unit into the installation groove and reduces use of materials.

A bottom of the first groove is arc-shaped, which can disperse a pressure, and at the same time, it can also disperse internal stress so as to prevent stress concentration and avoid uneven deformation of the floorboard connecting base and material fatigue.

Optionally, an end of the lower surface of the base body is provided with a first chamfer for providing a deformation space. A structure with the first chamfer can achieve effect similar to that of the first groove. The first chamfer is provided to cause the lower surface of the base body to have a structure with a low middle part and two tilted ends, and an end of the lower surface of the base body has a deformation space, which optimizes effect of pressing products into the installation groove and reduces the use of materials.

Optionally, a height of a step surface of the step block is not less than a height of the convex part. The limiting part has good elasticity, and the connecting post can smoothly enter the installation groove during installation of the floorboard unit, and the limiting part can rebound in situ to lock the floorboard unit when it is installed in place.

Optionally, the convex part and the bottom of the installation groove can be smoothly transitioned with a first concave arc part, so that the floorboard unit can smoothly enter the installation groove. In addition, the first concave arc part and the step surface of the step block are distributed in an oblique diagonal structure. After the floorboard unit and the floorboard connecting base are locked, a hooking part of the floorboard unit and the step surface are locked with each other, and at the same time, the hooking part abuts against the first concave arc part, so that the connecting post of the floorboard unit is more stable with a diagonal locking structure.

Optionally, the number of the convex part is two, the two convex parts are located at the two ends of the upper surface of the base body, and the limiting part is located between the two convex parts. The free end of the limiting part is formed with two step blocks bent in the direction of the two convex parts, respectively, so that two adjacent floorboard units can be connected through the floorboard connecting base.

Optionally, the limiting part is provided with a U-shaped groove in a vertical direction. When the connecting post of the floorboard unit is dropped into the installation groove, the step block and the convex part can open to both sides, and an elastic deformation space can be provided for the limiting part when the U-shaped groove is squeezed, which optimizes effect of pressing the floorboard unit into the installation groove and reduces use of materials.

When the floorboard unit is installed, the connecting post exerts a force on both the step block and the convex part, and the lack of the first groove or the first chamfer, i.e., the convex part lacks an elastic deformation space, the limiting part is prone to excessive deformation leading to the failure of the locking type connection structure; and the lack of the U-shaped groove, i.e., the limiting part lacks an elastic deformation space, the convex part is similarly susceptible to excessive deformation leading to the failure of the locking type connection structure. Therefore, the U-shaped groove of the limiting part and the first groove/the first chamfer of the convex part make the limiting part and the convex part have excellent elastic deformation ability in the direction of force, which not only ensures that the limiting part and the convex part are not easy to be damaged, but also ensures that the floorboard unit is smoothly pressed into the floorboard connecting base, and that the paving efficiency is high.

Optionally, a bottom of the U-shaped groove is provided with a second concave arc part, which can increase structural stability and strength of the step block.

Optionally, a notch of the U-shaped groove gradually expands outward. The notch of the U-shaped groove is of a gradually expanding trumpet-shaped structure, and deformation at an end of the limiting part (that is, at the step block) is largest when the connecting post of the floorboard unit is dropped, leaving a sufficient space for deformation of the step block. In addition, the notch of the U-shaped groove is designed so that the step block forms a chamfer, which assists in stress release, and can also avoid a sharp structure and not hurt hands in assembling and disassembling.

Optionally, the step block has a triangular structure, and the step block has a first sloping face, and the first sloping face is a plane or a convex arc face. The triangular step block is not only stable in structure, but also the sloping face of the step block which is of a plane or convex arc face structure can make the floorboard unit drop into the installation groove smoothly when pressed. The groove (a first recess) of the floorboard unit corresponding to the step block is designed to be similar to a trapezoidal structure, which can not only assist in smooth dropping into the installation groove when pressed, but also enable the hooking part to stably engage with the step block.

Optionally, a first included angle $\alpha$ between the step block and the limiting part is 90° to 135°. The first included angle $\alpha$ of 90° to 135° can ensure stability of a connecting structure between the floorboard connecting base and the floorboard unit, and also make assembly and disassembly of the floorboard unit smoother.

An end of the step block is a convex circular arc, so a contact area between the floorboard unit and the step block is small, also with small friction resistance, and an installation process is smoother.

Optionally, the convex part is provided with a first convex arc part for assisting the floorboard unit in being inserted into the installation groove. When the floorboard unit is installed and dropped into the floorboard connecting base, the first convex arc part contacts the connecting post of the floorboard unit, which can assist smooth entry into the installation groove.

Optionally, the convex part is further provided with a second convex arc part, which can also assist the floorboard unit in being smoothly clamped with the floorboard connecting base. Radians of the first convex arc part and the second convex arc part can be changed to be adapted with shapes of a second recess and the third convex arc part of the floorboard unit.

A floorboard connecting structure is further provided in this disclosure, which includes a floorboard unit and the floorboard connecting base described above. The floorboard unit is provided with a connecting post clamped into the installation groove, an end of the connecting post is provided with a hooking part, and the step block is clamped and matched with the hooking part. When the connecting post of the floorboard unit is clamped into the installation groove, the hooking part of the floorboard unit and the step block are not easy to come off after locking and fastening each other because the step block of the floorboard connecting base enters the first recess of the floorboard unit.

Structural strength of the floorboard connecting base is not less than that of the floorboard unit. Specifically, the floorboard unit can be made of wood composite materials, such as medium density fiberboard (MDF) or high density fiberboard (HDF), or can be made of natural wood, bamboo, or other materials with elasticity. The floorboard connecting base can be made of plastic or metal.

Optionally, there are at least two joint surfaces between the connecting post and an inner wall of the installation groove, which are formed by closely matching planes and/or the arc faces, and two of the at least two joint surfaces are distributed in a relative structure or an oblique diagonal structure. The connecting post of the floorboard unit is locked in the installation groove by a diagonal structure, with a stable clamping structure.

Optionally, the two of the at least two joint surfaces are a horizontal face and a first arc sloping face distributed in an oblique diagonal structure, and a vertical face for assisting in clamping and fastening is also included between the floorboard unit and the floorboard connecting base. Specifically, the horizontal plane is formed by abutting of the step surface of the step block and the hooking part, and the first arc sloping face is formed by abutting of the first concave arc part of the floorboard connecting base and the third convex arc part of the floorboard unit. The first arc sloping face has horizontal and vertical directions, which correspond to the horizontal face and the vertical face respectively, with large contact area and a stable limiting structure.

Optionally, two of the at least two joint surfaces are a first arc sloping face and a second arc sloping face distributed in an oblique diagonal structure, and a vertical face for assisting in clamping and fastening is also included between the floorboard unit and the floorboard connecting base. Specifically, the first arc sloping face is formed by abutting of the first concave arc part of the floorboard connecting base and the third convex arc part of the floorboard unit, and the second arc sloping face is formed by abutting of the step block and the hooking part. Both the first arc sloping face and the second arc sloping face have horizontal and vertical directions with large contact area, and in combination with the vertical surface for assisting in clamping, the limiting structure is stable.

Optionally, the hooking part has an introduction sloping face, and a slope of the introduction sloping face is greater than a slope of a sloping face of the step block. When the hooking part is pressed into the installation groove, it can contact with the sloping face of the step block. When the slope of the introduction sloping face is larger than that of the sloping face of the step block, a contact area between the step block and the hooking part can be reduced, thereby reducing friction effect, reducing elastic deformation of the limiting part and avoiding structural failure of the limiting part due to excessive deformation. In addition, after the hooking part is clamped, it can cooperate with the limiting part to form a triangular gap, with a stable structure.

The disclosure has following beneficial effects. With the floorboard connecting base according to this disclosure, the floorboard unit is clamped into the installation groove between the limiting part and the convex part, and the step block formed by folding the free end of the limiting part towards the convex part can form a semi-enclosed limiting structure for the inserted floorboard unit, so that the floorboard can be stably inserted and clamped, which is with a simple clamping structure, reduces processing loss of profiles by 3% to 5%, is suitable for diversity of floorboard paving and stable in structure.

The floorboard connecting structure according to the disclosure is of a locking type, so it can be paved without glue due to a locking force, which is safe and environment-friendly and with tight joints. A whole structure may extend all around with change of temperature, and there will be no problems such as uplift or cracking due to the change of temperature, with good overall paving effect. For the floorboard connecting structure of the disclosure, a manual paving standard is replaced with an industrial standard, so that error of manual paving is reduced, and the floorboard can enter the groove by pressing or tapping the floorboard when paved, and its installation is simple.

Reference numbers are as follows: 1. Floorboard Connecting Base; 10. Base Body; 11. Convex Part; 12. Limiting Part; 13. Installation Groove; 14. First Groove; 15. First Chamfer; 16. First Concave Arc Part; 17. Seam Filling Part; 111. First Convex Arc Part; 112. Second Convex Arc Part; 121. Step Block; 122. U-shaped Groove; 123. Second Concave Arc Part; 121*a*. First Sloping Face; 121*b*. End of Step Block; 121*c*. Step Surface;

2. Floorboard Unit; 20. Floorboard Body; 21. Connecting Post; 22. Second Groove; 23. Second Chamfer; 24. Second Right-Angle Groove; 25. Second Insertion Block; 211. Hooking Part; 212. Third Convex Arc Part; 221. First Recess; 222. Second Recess; 211*a*. Introduction Sloping Face; 221*a*. Third Chamfer; 221*b*. Fourth Chamfer;

2*a*. First Floorboard Unit; 2*b*. Second Floorboard Unit;

3. Floorboard Connection Structure; 31. Horizontal Face; 32. First Arc Sloping Face; 33. Vertical Face; 34. Second Arc Sloping Face; 35. Floorboard Connector; 351. Transversal Part; 352. Longitudinal Part; 353. Curved part; 353*a*. First Right-Angle Groove; 353*b*. Barrier Wall; 353*c*. First Insertion Block; 353*d*. Right-Angle Cavity; 353*e*. Separating Groove;

α. First Included Angle; β. Second Included Angle.

DETAILED DESCRIPTION

In the following, a detailed and complete description of the present disclosure will be made in combination with specific embodiments with reference to the drawings.

Figure 1:
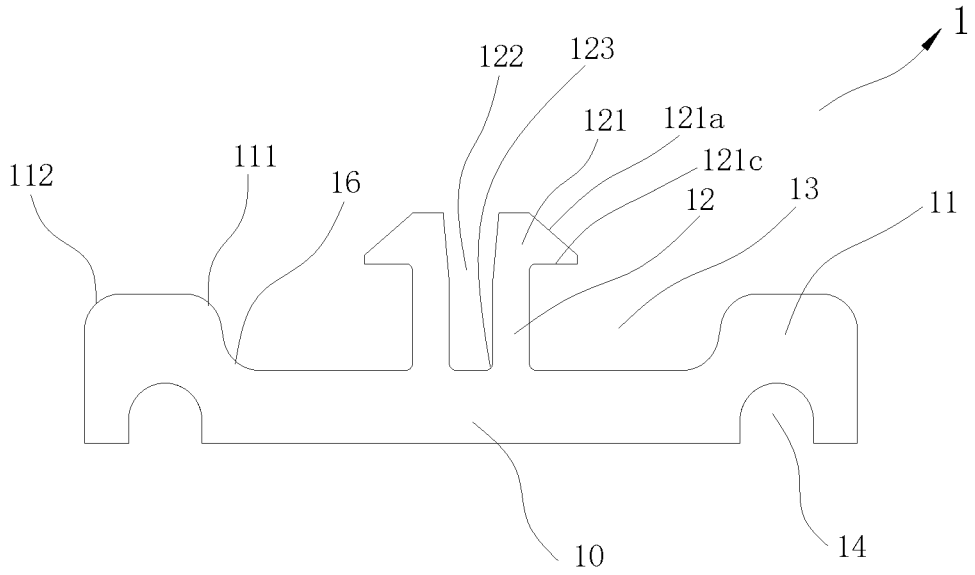
FIG. 1 is a schematic view of a floorboard connecting base according to an embodiment.
Figure 4:
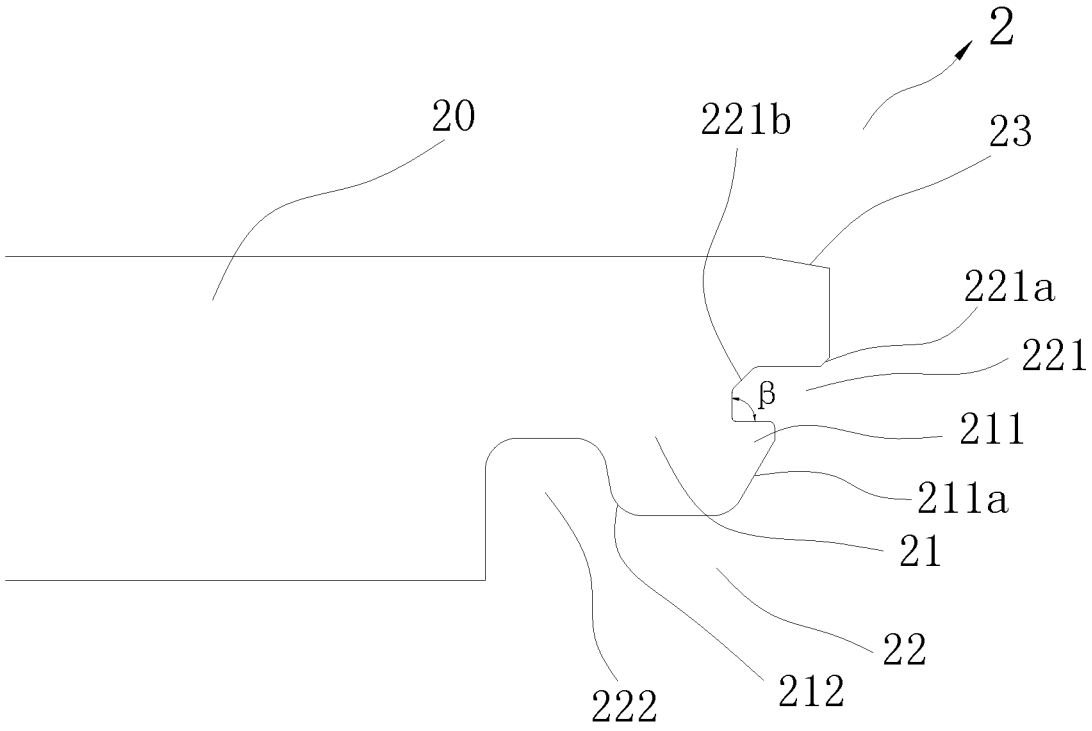
FIG. 4 is a schematic structural diagram of a floorboard unit according to an embodiment.

Referring to FIGS. 1 and 4, a floorboard connecting base 1 is provided in the present disclosure, which includes a base body 10, a convex part 11 and a limiting part 12. The convex part 11 and the limiting part 12 are located on an upper surface of the base body 10, and the convex part 11 and the limiting part 12 are arranged at intervals to form a mounting groove 13. When installed, a floorboard unit 2 is clamped into the mounting groove 13. A free end of the limiting part 12 is bent toward the convex part 11 to form a step block 121, which can form a semi-enclosed limiting structure for the inserted floorboard unit 2. The floorboard unit 2 can be stably matched, inserted and clamped with the floorboard connecting base 1, which is with a simple clamping structure and is suitable for diversity of floorboard paving and stable in structure.

Figure 8:
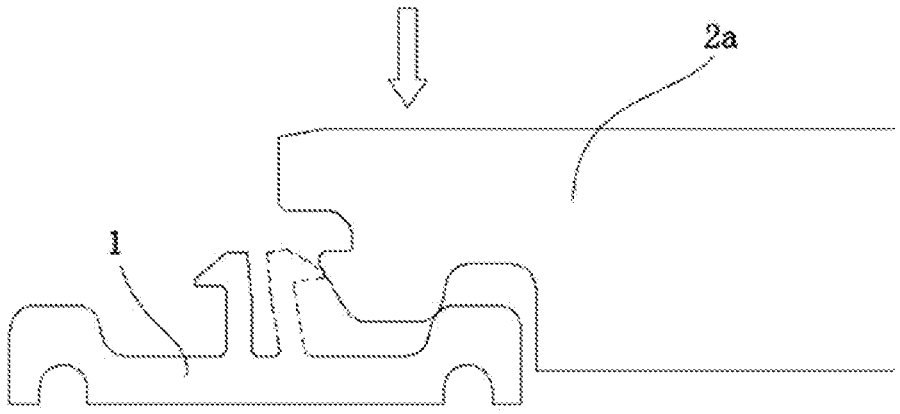
FIG. 8 is a schematic view of deformation of a step block and a convex part after being subjected to an expanding and extruding force when a first floorboard unit is pressed downward.
Figure 9:
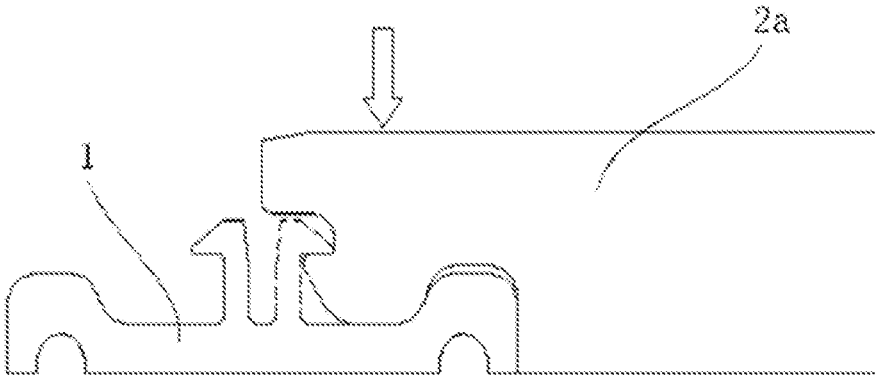
FIG. 9 is a schematic view of a step block being rebounded, hooked to a hooking part and tightly locked after the connecting post of the first floorboard unit is installed in the installation groove of the floorboard connecting base.
Figure 10:
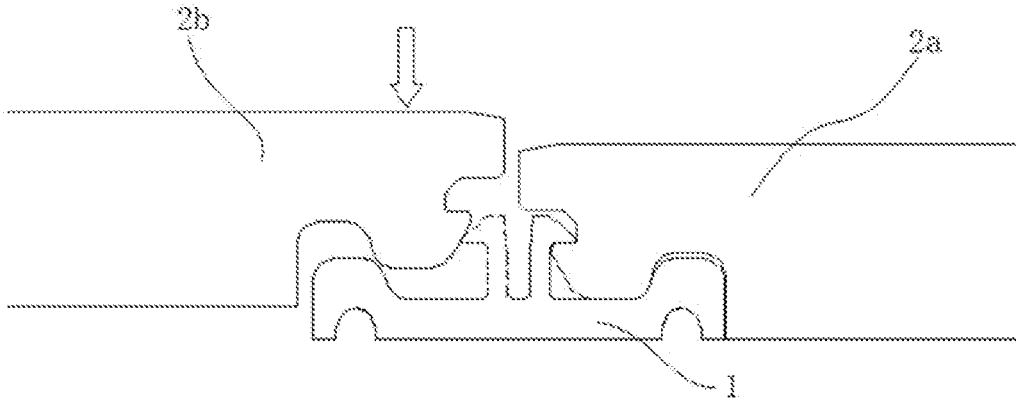
FIG. 10 is a schematic view of a step block and a convex being subjected to an expanding and extruding force when a second floorboard unit is pressed downward.
Figure 11:
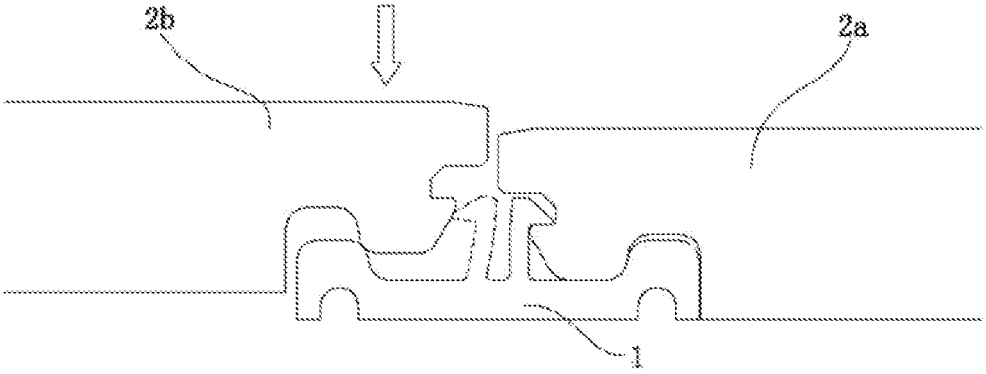
FIG. 11 is a schematic view of deformation of a step block and a convex after being subjected to an expanding and extruding force when a second floorboard unit is pressed downward.
Figure 12:
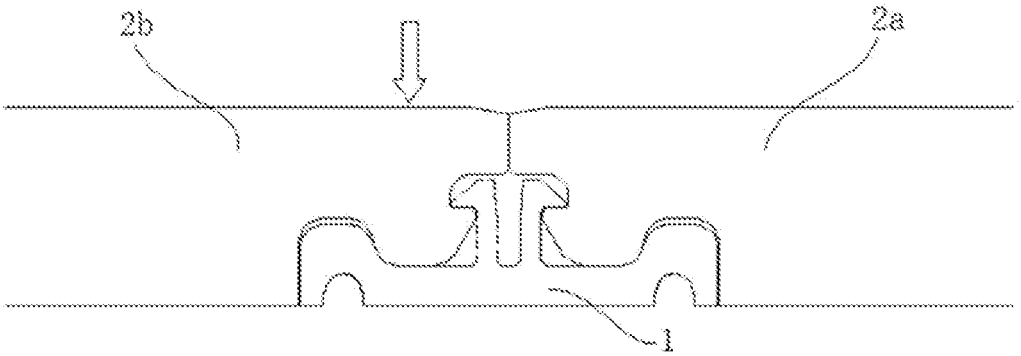
FIG. 12 is a schematic view of a step block being rebounded, hooked to a hooking part and tightly locked after the connecting post of the second floorboard unit is installed in the installation groove of the floorboard connecting base.

Referring to FIG. 1, in an embodiment, the base body 10 is provided with a first groove 14, and the first groove 14 is located below the convex part 11. Referring to FIG. 8 and FIG. 11, when the connecting post 21 of the floorboard unit 2 is dropped into the installation groove 13, the step block 121 and the convex part 11 can open to both sides. At this time, an elastic deformation space of the convex part 11 can be ensured when the first groove 14 is squeezed, which optimizes effect of pressing the floorboard unit 2 into the installation groove 13 and reduces use of materials.

A bottom of the first groove 14 is arc-shaped, which can evenly disperse a pressure, and at the same time, it can also disperse internal stress so as to prevent stress concentration, avoid uneven deformation of the floorboard connecting base 1 and damage due to material fatigue.

Figure 2:
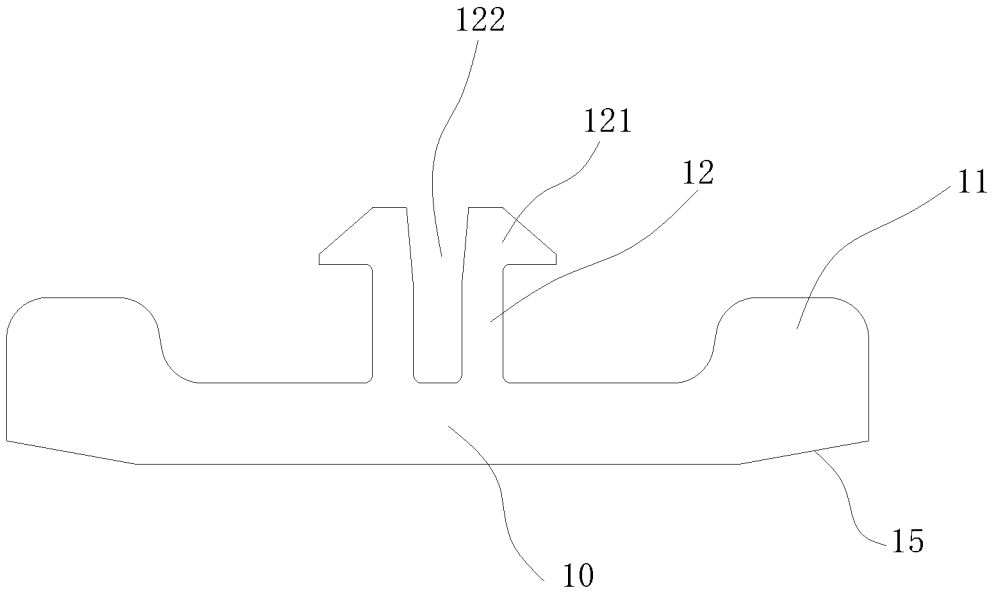
FIG. 2 is a schematic view of a floorboard connecting base according to another embodiment.

Referring to FIG. 2, in another embodiment, the base body 10 is provided with a first chamfer 15. A structure with the first chamfer 15 can achieve effect similar to that of the first groove 14. The first chamfer 15 is provided to cause a lower surface of the base body 10 to have a structure with a low middle part and two tilted ends, that is, an end of the lower surface of the base body 10 has a deformation space, which can also optimize effect of pressing products into the installation groove 13 and reduce the use of materials.

Referring to FIG. 1, a height of a step surface 121*c* of the step block 121 is not less than a height of the convex part 11. The limiting part 12 has good elasticity, and the connecting post 21 can smoothly enter the installation groove 13 during installation of the floorboard unit 2, and the limiting part can rebound in situ to lock the floorboard unit 2 when it is installed in place.

Referring to FIG. 1, the convex part 11 and the bottom of the installation groove 13 can be smoothly transitioned with a first concave arc part 16, so that the floorboard unit 2 can smoothly enter the installation groove 13. In addition, the first concave arc part 16 and the step surface of the step block 121 are distributed in an oblique diagonal structure. After the floorboard unit 2 and the floorboard connecting base 1 are locked, a hooking part 211 of the floorboard unit 2 and the step surface are locked with each other, and at the same time, the hooking part 211 abuts against the first concave arc part 16, so that the connecting post 21 of the floorboard unit 2 is more stable with a diagonal locking structure.

Referring to FIGS. 1 to 2, the limiting part 12 is provided with a U-shaped groove 122 in a vertical direction. When the connecting post 21 of the floorboard unit 2 is dropped into the installation groove 13, the step block 121 and the convex part 11 can open to both sides (as shown in FIGS. 8 and 11), and the U-shaped groove 122 can provide an elastic deformation space for the limiting part 12 when it is squeezed. A bottom of the U-shaped groove 122 is provided with a second concave arc part 123 which can increase structural stability and strength of the step block 121. A notch of the U-shaped groove 122 gradually expands outwards into a trumpet-shaped structure, which provides a larger deformation space for the step block 121.

Figure 3:
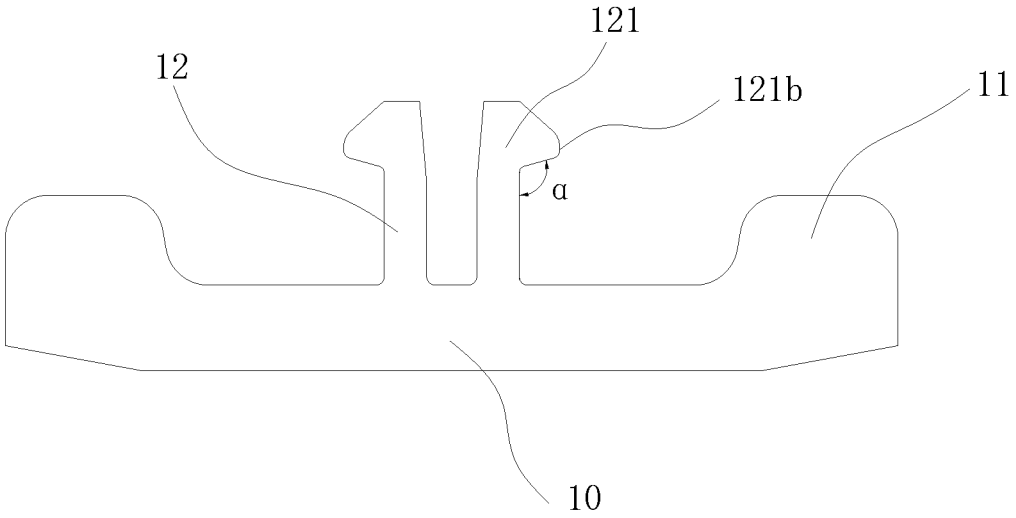
FIG. 3 is a schematic view of a floorboard connecting base according to yet another embodiment.

Referring to FIGS. 1 to 3, the step block 121 is of a stable triangular structure, and the step block 121 has a first sloping face 121*a*, and the first sloping face 121*a* is a plane or a convex arc face, so as to assist floorboard unit 2 in smoothly dropping into the installation groove 13 when pressed.

Referring to FIG. 3, a first included angle α between the step block 121 and the limiting part 12 is 90° to 135°, which can ensure stability of a connecting structure between the floorboard connecting base 1 and the floorboard unit 2, and also make assembly and disassembly of the floorboard unit 2 smoother. An end of the step block 121 is a convex circular arc, so a contact area between the floorboard unit 2 and the step block 121 is small, also with small friction resistance, which can also assist in smooth assembly and disassembly. If the first included angle α is less than 90°, and the floorboard unit 2 will be difficult to dismantle. If the first included angle α is greater than 135°, and the connection structure of the floorboard connecting base 1 and the floorboard unit 2 will be unstable.

Referring to FIG. 1, the convex part 11 is provided with a first convex arc part 111. When the floorboard unit 2 is installed and dropped into the floorboard connecting base 1, the first convex arc part 111 contacts the connecting post 21 of the floorboard unit 2, which can assist smooth entry into the installation groove 13. The convex part 11 is further provided with a second convex arc part 112, which can also assist the floorboard unit 2 in being smoothly clamped with the floorboard connecting base 1.

Figure 13:
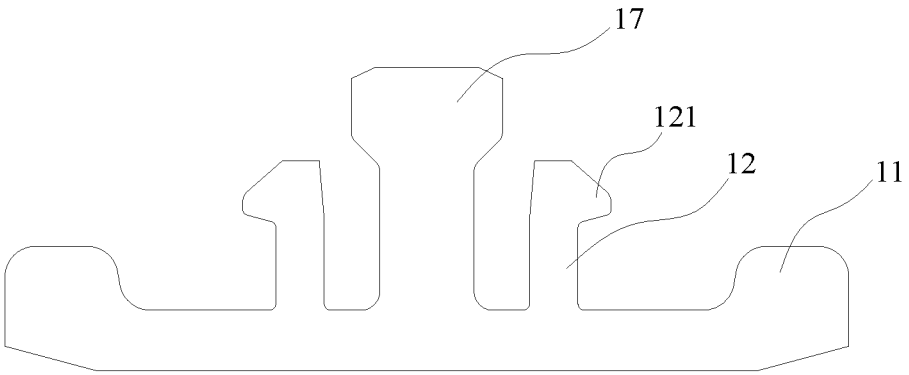
FIG. 13 is a schematic view of a floorboard connecting base according to still another embodiment.
Figure 14:
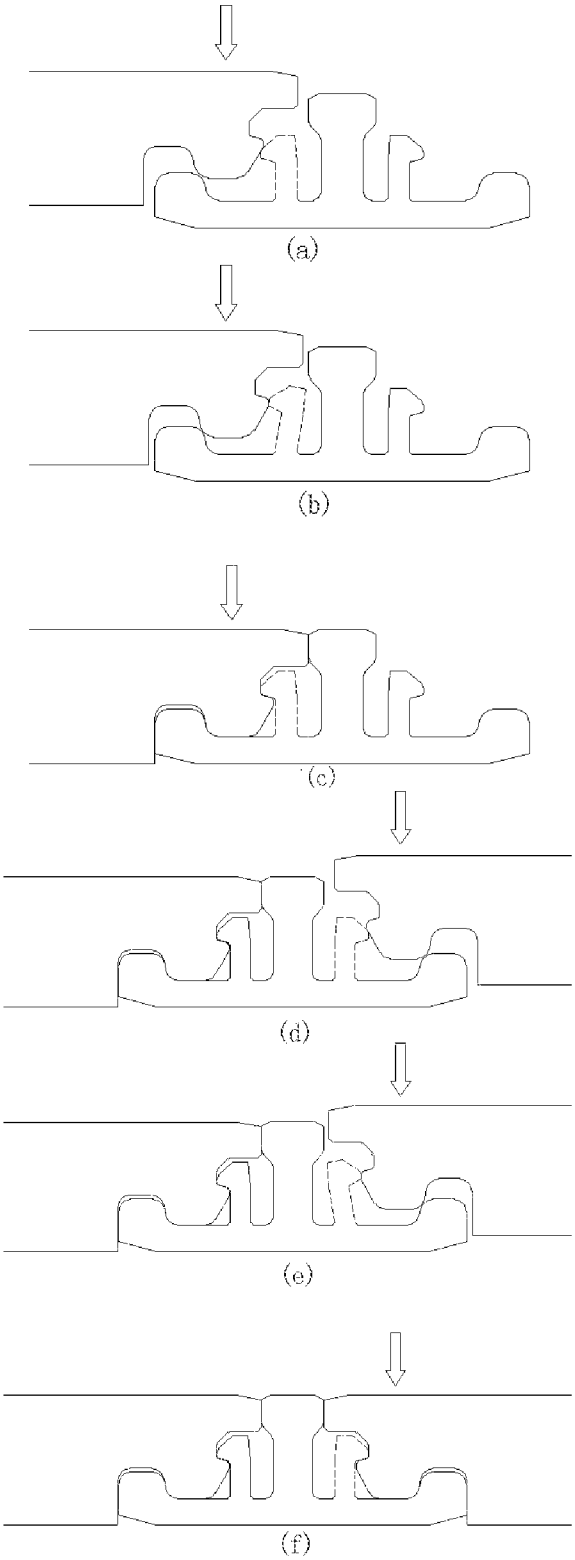
In FIG. 14, (a) (b) (c) (d) (e) (f) are schematic views of a floorboard unit pressed into the floorboard connecting base shown in FIG. 13.

Referring to FIG. 13 and (a) (b) (c) (d) (e) (f) in FIG. 14, the floorboard connecting base is further provided with a seam filling part 17. The seam filling part 17 is disposed in a columnar structure in a vertical direction within the u-shaped groove 122, and the height of the seam filling part 17 is higher than that of the limiting part 12, so that after the floorboard unit 2 is installed, the seam filling part 17 is able to be flush with the upper surface of the floorboard unit 2, thereby achieving the purpose of filling a seam between two adjacent floorboard units 2.

Referring to FIG. 4, a floorboard unit 2 is provided in this disclosure, which includes a floorboard body 20 and a connecting post 21. The connecting post 21 is located at an end edge of a lower surface of the floorboard body 20, and an end of the connecting post 21 is provided with a hooking part 211 folded in a direction toward an end of the floorboard body 20, and the hooking part 211 is of an approximate trapezoidal structure, and the hooking part 211 is provided with an introduction sloping face 211*a* for auxiliary clamping. The approximate trapezoidal hooking part 211 is simple and stable in structure, which enables the connecting post 21 to have strength and to produce tension with the floorboard connecting base 1. The introduction sloping face 211*a* can assist in smoothly pressing downward and install the floorboard unit 2 to be clamped into the floorboard connecting base 1, so as to be closely connected with the floorboard connecting base 1. After the hooking part 211 of the floorboard unit 2 is pressed into the floorboard connecting base 1, the hooking part 211 can be locked, and closely connected, with a step block 121 of a base body 10.

Referring to FIG. 4, the hooking part 211 is bent to form a second included angle β, and the second included angle β is 90° to 135°, which can ensure stability of a connecting structure between the floorboard connecting base 1 and the floorboard unit 2, and also make assembly and disassembly of the floorboard unit 2 smoother. If the second included angle β is less than 90°, and the floorboard unit 2 will be difficult to dismantle. If the second included angle β is greater than 135°, and the connection structure of the floorboard connecting base 1 and the floorboard unit 2 will be unstable.

Referring to FIG. 4, the introduction sloping face 211*a* is a plane or a convex arc face, so that the floorboard unit 2 can be smoothly dropped into an installation groove 13 of the floorboard connecting base 1 when pressed.

Optionally, an edge of an upper surface of the floorboard body 20 is provided with a second chamfer 23, and a third chamfer 221*a* is provided at a first recess 221 of the floorboard body 20, which can assist stress release, avoid a sharp structure, and do not hurt hands during disassembly. In addition, it can provide an expansion deformation space for thermal expansion and contraction.

Referring to FIG. 4, the end edge of the lower surface of the floorboard body 20 is provided with a second groove 22, and the connecting post 21 is located in the second groove 22 to divide the second groove 22 into a first recess 221 and a second recess 222. The connecting post 21 does not protrude from the floorboard body 20, which is not easy to be damaged and is also more beautiful. A bottom of the second recess 222 is smoothly transitioned with an arc, and contacts with the floorboard connecting base 1 to achieve smooth transition effect.

Referring to FIG. 4, a third convex arc part 212 is provided at a side of the connecting post 21 proximate to the second recess 222, and the third convex arc part 212 and the hooking part 211 are distributed in an oblique diagonal structure. After the floorboard unit 2 and the floorboard connecting base 1 are locked, the hooking part 211 of the floorboard unit 2 and a step surface of the floorboard connecting base 1 are locked with each other, and at the same time the third convex arc part 212 abuts against the floorboard connecting base 1, so that the connecting post 21 of the floorboard unit 2 is more stable with the diagonal locking structure.

Referring to FIG. 4, a bottom of the first recess 221 is provided with a fourth chamfer 221*b*. The fourth chamfer 221*b* can enhance stability of a part between the second chamfer 23 and the third chamfer 221*a* of the floorboard body 20.

Figure 5:
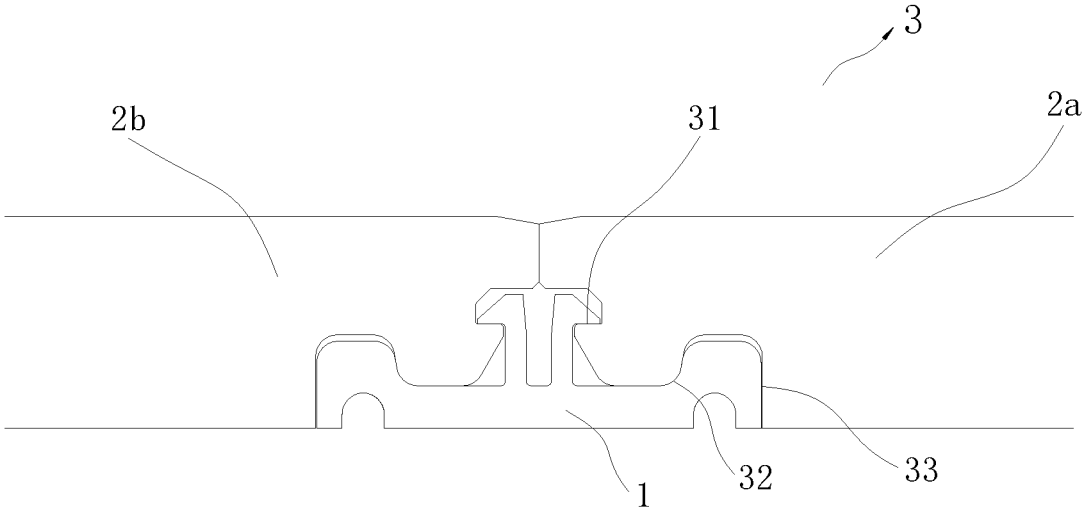
FIG. 5 is a schematic view of a structure of a floorboard connecting base according to an embodiment.
Figure 6:
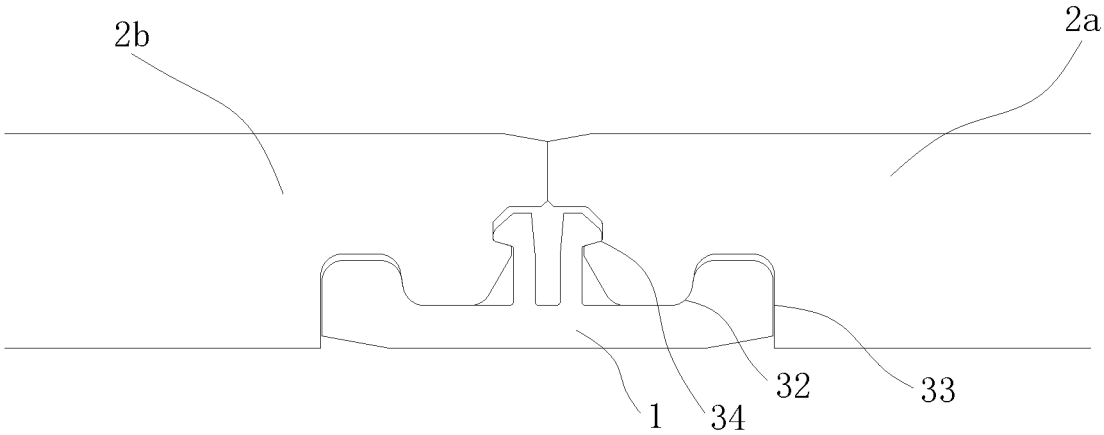
FIG. 6 is a schematic view of a structure of a floorboard connecting base according to another embodiment.
Figure 7:
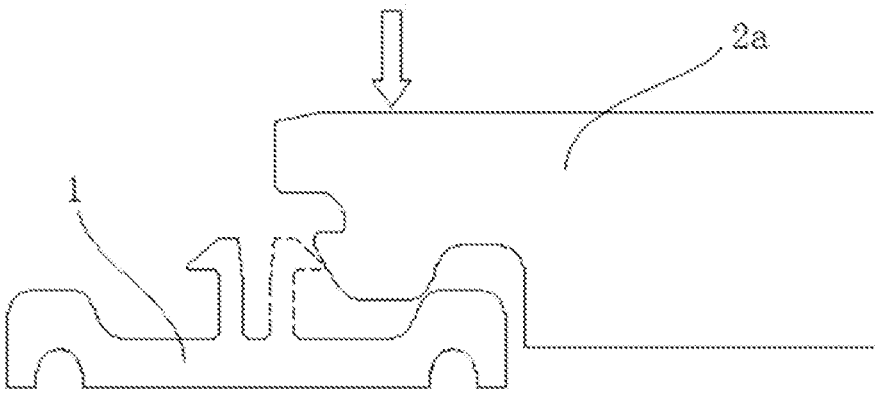
FIG. 7 is a schematic view of a step block and a convex part being subjected to an expanding and extruding force when a first floorboard unit is pressed downward.

Referring to FIGS. 5 to 6, a floorboard connection structure 3 is further provided in the present disclosure, in which two adjacent floorboard units 2 (a first floorboard unit 2*a* and a second floorboard unit 2*b*) are connected through the floorboard connecting base 1. The connecting post 21 of the floorboard unit 2 is clamped into the installation groove 13, and the hooking part 211 of the connecting post 21 is engaged and matched with the step block 121 of the floorboard connecting base 1. The hooking part 211 of the floorboard unit 2 and the step block 121 are not easy to come off after locking and fastening each other, since the step block 121 of the floorboard connecting base 1 enters the first recess 221 of the floorboard unit 2. A specific installation process of the first floorboard unit 2*a* and the second floorboard unit 2*b* is shown in FIGS. 7 to 12. Wherein, the convex part 11 may act as a restriction for the first floorboard unit 2*a* and the second floorboard unit 2*b* in the horizontal direction.

Referring to FIGS. 5 to 6, there are at least two joint surfaces between the connecting post 21 and an inner wall of the installation groove 13, which are formed by closely matching planes and/or arc faces, and two of the at least two joint surfaces are distributed in a relative structure or an oblique diagonal structure. The connecting post 21 of the floorboard unit 2 and the floorboard connecting base 1 are locked by a diagonal structure, with a stable clamping structure.

Referring to FIG. 5, in an embodiment, two of the at least two joint surfaces are a horizontal face 31 and a first arc sloping face 32 distributed in an oblique diagonal structure, and a vertical face 33 is further included between the floorboard unit 2 and the floorboard connecting base 1. Specifically, the horizontal plane 31 is formed by abutting of the step surface 121*a* of the step block 121 and the hooking part 211, and the first arc sloping face 32 is formed by abutting of the first concave arc part 16 of the floorboard connecting base 1 and the third convex arc part 212 of the floorboard unit 2. The first arc sloping face 32 has horizontal and vertical directions, which are opposite to the horizontal face 31 and the vertical face 33 respectively, and the limiting structure is stable.

Referring to FIG. 6, in an embodiment, two of the at least two joint surfaces are a first arc sloping face 32 and a second arc sloping face 34 distributed in an oblique diagonal structure, and a vertical face 33 is further included between the floorboard unit 2 and the floorboard connecting base 1. Specifically, the first arc sloping face 32 is formed by abutting of the first concave arc part 16 of the floorboard connecting base 1 and the third convex arc part 212 of the floorboard unit 2, and the second arc sloping face 34 is formed by abutting of the step block 121 and the hooking part 211. Both the first arc sloping face 32 and the second arc sloping face 34 have horizontal and vertical directions, and in combination with the vertical surface 33 for assisting in clamping, the limiting structure is stable.

Referring to FIGS. 1, 4 and 5, a slope of the introduction sloping face 211*a* is greater than that of a sloping face of the step block 121. When the hooking part 211 is pressed into the installation groove 13, it can contact with the sloping face of the step block 121. When the slope of the introduction sloping face 211*a* is larger than that of the sloping face of the step block 121, a contact area between the step block 121 and the hooking part 211 can be reduced, thereby reducing friction effect, reducing elastic deformation of the limiting part 12 and avoiding structural failure of the limiting part 12 due to excessive deformation. In addition, after the hooking part 211 is clamped, it cooperates with the limiting part 12 to form a triangular gap, with a stable structure.

Figure 18:
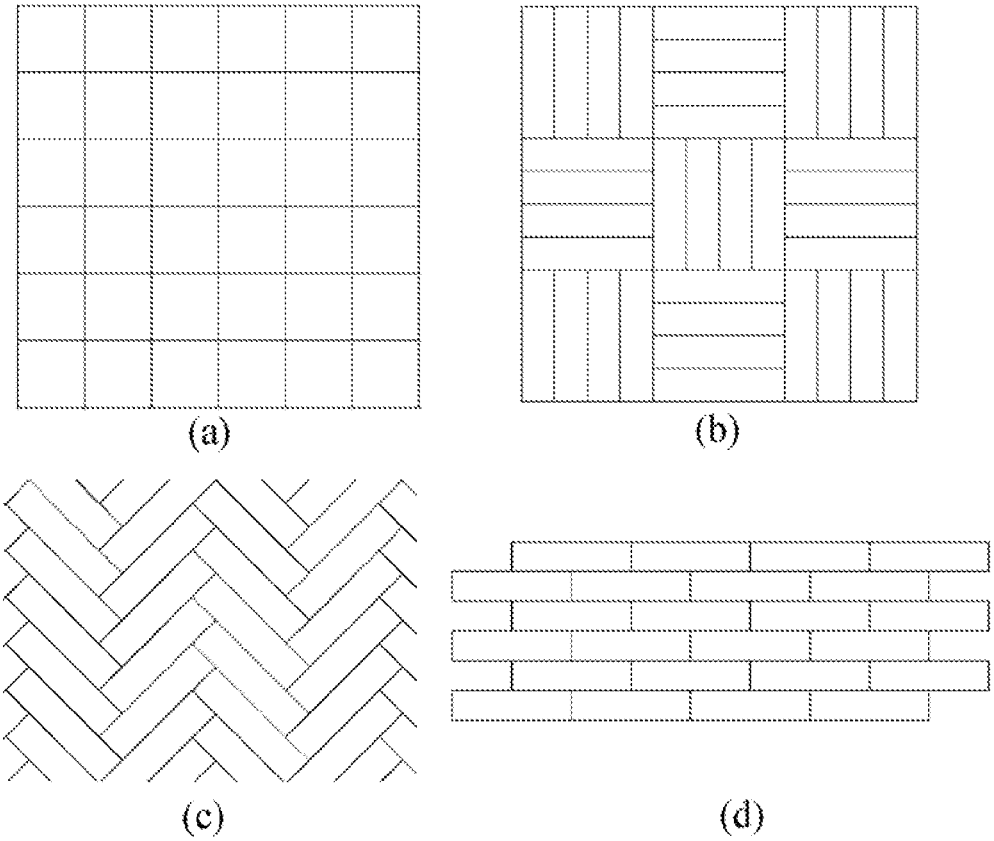

Referring to (a) (b) (c) (d) shown in FIG. 18, various splicing structures can be constituted by the floorboard connecting base 1 and the floorboard unit 2 in the present disclosure. In addition, compared to the existing method of connecting by separately providing male buckles and female buckles on adjacent floorboard units, the floorboard unit 2 in the present disclosure has a consistent groove structure, which facilitates manufacturing.

Figure 15:
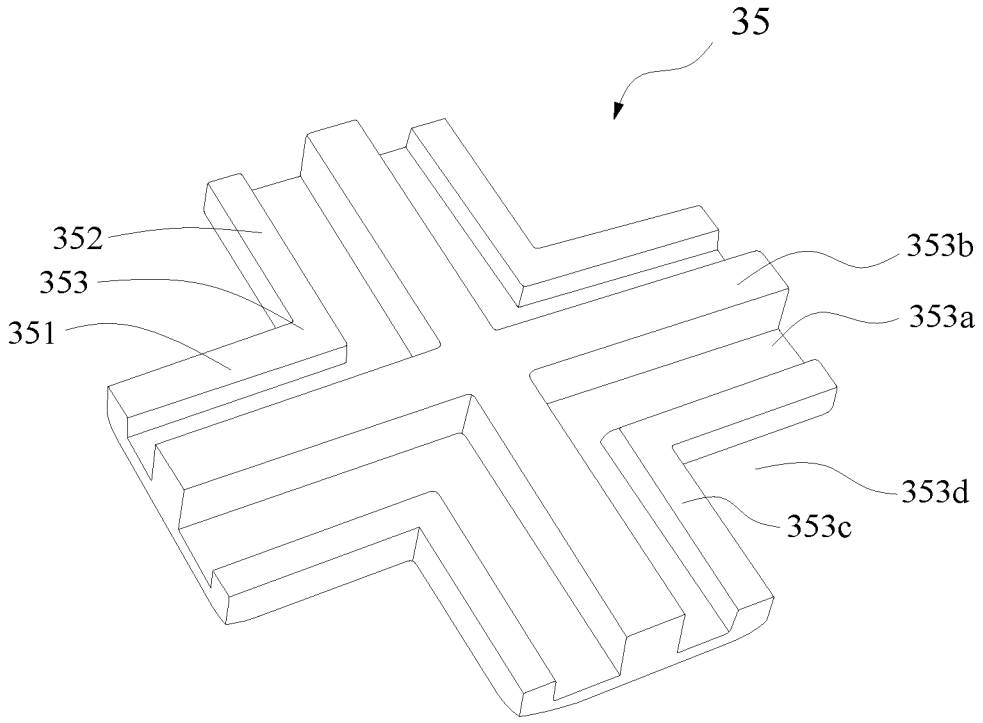
FIG. 15 is a schematic view of a floorboard connector according to an embodiment.
Figure 16:
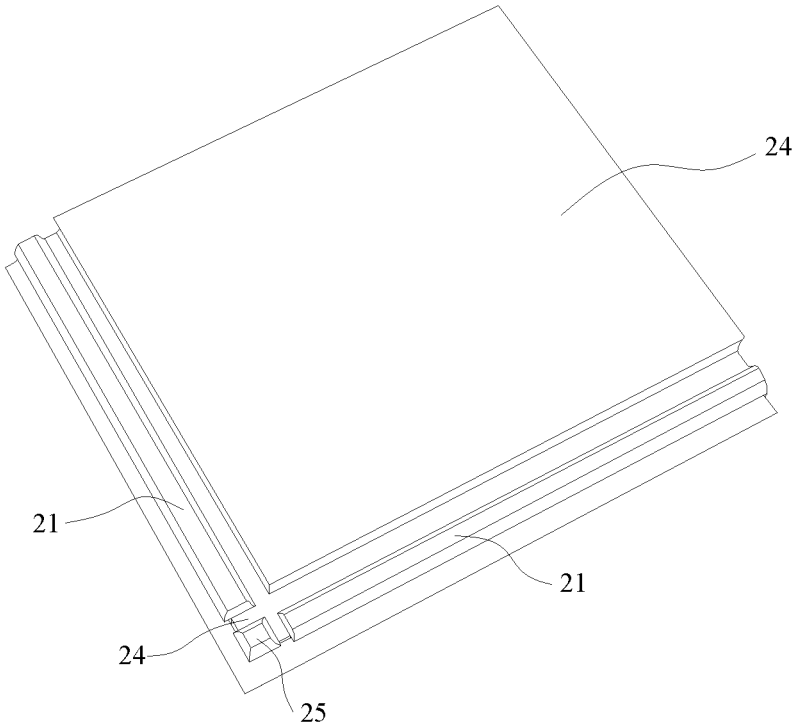
FIG. 16 is a schematic view of a lower surface of a floorboard unit according to an embodiment.

Referring to FIG. 15, the floorboard connection structure 3 further provides a floorboard connector 35 having a transversal part 351 and a longitudinal part 352. The transversal part 351 and the longitudinal part 352 are perpendicular to each other and cross. Four curved parts 353 are formed at the cross positions of the transversal part 351 and the longitudinal part 352, and each of the curved part 353 is provided with a first right-angle groove 353*a*, and the first right-angle groove 353*a* separates the floorboard connector 35 to form a barrier wall 353*b* located at a middle portion and four first insertion blocks 353*c* of the right-angled structure. Referring to FIG. 16, it is shown that the floorboard unit 2 is rectangular, with a second right-angle groove 24 and a second insertion block 25 provided at least one right angle of the rectangle. Each curved part 353 is used for the insertion of one floorboard unit 2.

Specifically, when the floorboard connector 35 is spliced with the floorboard unit 2, the connecting post 21 of the floorboard unit 2 is inserted into the first right-angle groove 353*a* of the floorboard connector 35, respectively, and the first insertion block 353*c* of the floorboard connector 35 is inserted into the second right-angle groove 24 of the floorboard unit 2, while the second insertion block 25 of the floorboard unit 2 falls into a right-angle cavity 353*d*. Since the floorboard connector 35 is a perpendicular cross-shape, it can assist four floorboard units 2 to quickly find the position and be aligned, and the seams of four floorboard units 2 are neater after paving, it can make the paving structure stable, and the floorboard unit 2 is not easily shifted when in use.

Wherein the height of the barrier wall 353*b* is greater than the height of the first insertion block 353*c*. The first insertion block 353*c* is shorter, which facilitates the insertion of the floorboard unit 2 into the floorboard connector 35, and the barrier wall 353*b* is higher which facilitates the restriction of the floorboard unit 2.

Figure 17:
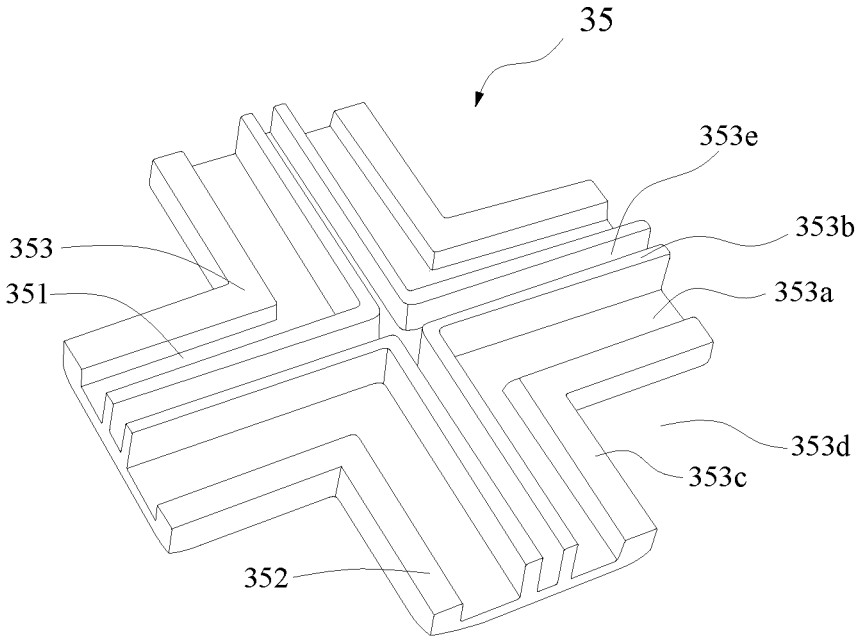
FIG. 17 is a schematic view of a floorboard connector according to another embodiment; and In FIG. 18, (a) (b) (c) (d) are schematic views of a plurality of floorboard connecting bases and a plurality of floorboard units constituting various splicing structures.

The upper surface of the barrier wall 353*b* may be flat surface or convex curved surface. Referring to FIG. 17, the middle of the barrier wall 353*b* is provided with a separating groove 353*e* along its length, which also reduces the use of materials while ensuring the structural soundness of the floorboard connector 35 and assisting in the quick alignment of the floorboard unit 2.

The above is only preferred embodiments of the present disclosure, which does not limit a protection scope of the present disclosure. Any equivalent transformation made with the specification of the present disclosure, which is directly or indirectly applied to other related technical fields, is included within the scope of the disclosure.

What is claimed is:

1. A floorboard connecting structure, comprising a floorboard unit and the floorboard connecting base, and a floorboard connector having a transversal part and a longitudinal part, wherein the floorboard unit is provided with a connecting post clamped into an installation groove, an end of the connecting post is provided with a hooking part;

the floorboard connecting base, comprising:

a base body;

a convex part located at an end of an upper surface of the base body; and a limiting part located at the upper surface of the base body and spaced from the convex part to form the installation groove for inserting the floorboard unit; wherein a free end of the limiting part is bent in a direction towards the convex part to form a step block for limiting the floorboard unit, and the step block is clamped and matched with the hooking part;

wherein the step block has a triangular structure, and the step block has a first sloping face, the first sloping face being a plane or a convex arc face;

wherein the hooking part is of an approximate trapezoidal structure, and the hooking part is provided with an introduction sloping face for auxiliary clamping, the introduction sloping face is a plane or a convex arc face, and a slope of the introduction sloping face is greater than a slope of the first sloping face;

wherein the limiting part is provided with a U-shaped groove in a vertical direction, a notch of the U-shaped groove gradually expands outward, a lower surface of the base body is provided with a first groove, and the first groove is located below the convex part, and a bottom of the first groove is arc-shaped; when the connecting post of the floorboard unit is dropped into the installation groove, the step block and the convex part can open to both sides, and an elastic deformation space of the convex part can be ensured when the first groove is squeezed;

wherein a first included angle $\alpha$ between the step block and the limiting part is an obtuse angle, and the first included angle $\alpha$ is not greater than 135°;

wherein the transversal part and the longitudinal part are perpendicular to each other and cross to form a perpendicular cross-shape, four curved parts are formed at the cross positions of the transversal part and the longitudinal part, and each of the curved parts is provided with a first right-angle groove, and the first right-angle groove separates the floorboard connector to form a barrier wall located at a middle portion and four first insertion blocks of the right-angled structure;

the floorboard unit is rectangular, with a second right-angle groove provided at least one right angle of the rectangle;

when the floorboard connector is spliced with the floorboard unit, the connecting post of the floorboard unit is inserted into the first right-angle groove of the floorboard connector, and the first insertion block of the floorboard connector is inserted into the second right-angle groove of the floorboard unit.

2. The floorboard connecting structure according to claim 1, wherein there are at least two joint surfaces between the connecting post and an inner wall of the installation groove, which are formed by closely matching planes and/or arc faces.

3. The floorboard connecting structure according to claim 2, wherein the two of the at least two joint surfaces are a horizontal face and a first arc sloping face distributed in an oblique diagonal structure, and a vertical face for assisting in clamping and fastening is also comprised between the floorboard unit and the floorboard connecting base.

4. The floorboard connecting structure according to claim 1, wherein the step block has a step surface, a height of the step surface of the step block is not less than a height of the convex part.

5. The floorboard connecting structure according to claim 4, wherein the convex part and the bottom of the installation groove can be smoothly transitioned with a first concave arc part, and the first concave arc part and the step surface of the step block are distributed in an oblique diagonal structure.

6. The floorboard connecting structure according to claim 1, wherein the convex part is provided with a first convex arc part for assisting the floorboard unit in being inserted into the installation groove.

* * * * *